US010048021B2

(12) United States Patent
Blomgren

(10) Patent No.: US 10,048,021 B2
(45) Date of Patent: Aug. 14, 2018

(54) REINFORCEMENT ARRANGEMENT FOR A MODULE OF HEAT TRANSFER PLATES IN A PLATE HEAT EXCHANGER

(75) Inventor: Ralf Blomgren, Skanör (SE)

(73) Assignee: ALFA LAVAL CORPORATE AB, Lund (SE)

( * ) Notice: Subject to any disclaimer, the term of this patent is extended or adjusted under 35 U.S.C. 154(b) by 1190 days.

(21) Appl. No.: 14/127,219

(22) PCT Filed: Jun. 19, 2012

(86) PCT No.: PCT/EP2012/061651
§ 371 (c)(1),
(2), (4) Date: Dec. 18, 2013

(87) PCT Pub. No.: WO2013/000760
PCT Pub. Date: Jan. 3, 2013

(65) Prior Publication Data

US 2014/0131020 A1 May 15, 2014

(30) Foreign Application Priority Data

Jun. 30, 2011 (EP) ..... 11172122

(51) Int. Cl.
*F28F 9/00* (2006.01)
*F28F 3/08* (2006.01)
*F28D 9/00* (2006.01)

(52) U.S. Cl.
CPC ..... *F28F 3/08* (2013.01); *F28D 9/005* (2013.01); *F28F 2225/00* (2013.01)

(58) Field of Classification Search
CPC ..... F28D 9/0043; F28D 9/005; F28D 9/0062; F28D 9/0093; F28D 7/0066;
(Continued)

(56) References Cited

U.S. PATENT DOCUMENTS 2,616,946 A * 11/1952 Scheer ..... H01J 1/36 174/151
3,255,817 A * 6/1966 Davids ..... B01D 3/065 165/140
(Continued)

FOREIGN PATENT DOCUMENTS

CN 101476832 A 7/2009
DE 25 05 640 A1 9/1975
(Continued)

OTHER PUBLICATIONS

International Search Report (PCT/ISA/210) dated Feb. 4, 2013, by the European Patent Office as the International Searching Authority for International Application No. PCT/EP2012/061651.
(Continued)

*Primary Examiner* — Len Tran
*Assistant Examiner* — Eric Ruppert
(74) *Attorney, Agent, or Firm* — Buchanan Ingersoll & Rooney PC

(57) ABSTRACT

A module of heat transfer plates which are welded to each other comprises a first outer heat transfer plate, at least a first and a second heat transfer plate, and a first reinforcement arrangement. Port holes form a first port channel in the module. The first reinforcement arrangement comprises a first abutment member and a first supporting member. The first abutment member is arranged on a side of the first outer heat transfer plate opposite to the first heat transfer plate. The first supporting member is arranged between the first abutment member and the first outer heat transfer plate. The first supporting member abuts against the first abutment member and the first outer heat transfer plate. Further a heat exchanger comprising such a module is provided.

18 Claims, 6 Drawing Sheets

(58) Field of Classification Search
CPC ..... F28F 2225/00; F28F 2230/00; F28F 2280/06; F28F 3/08; F28F 3/10; F28F 2275/06; F16L 41/082; F16L 41/084; Y10T 403/64
USPC ..... 165/167, 285, 144, 906, DIG. 364, 369, 165/359, 371, 372, 373
See application file for complete search history.

(56) References Cited

U.S. PATENT DOCUMENTS 4,872,578 A * 10/1989 Fuerschbach ..... F28D 9/005 165/166
5,462,113 A * 10/1995 Wand ..... F28D 9/0093 165/140
5,511,612 A * 4/1996 Tajima ..... F28D 9/0012 165/167
5,722,486 A * 3/1998 Blomgren ..... F28D 9/0037 165/167
5,778,975 A * 7/1998 Nilsson ..... F28F 3/083 165/167
5,797,446 A * 8/1998 Blomgren ..... F28D 9/00 165/167
6,016,865 A * 1/2000 Blomgren ..... F28D 9/0043 165/148
6,116,332 A * 9/2000 Vannman ..... F28F 3/083 165/167
6,142,221 A * 11/2000 Johansson ..... F28D 9/0093 165/140
2007/0000639 A1* 1/2007 Ozawa ..... F28D 9/0043 165/41
2007/0023175 A1* 2/2007 Richter ..... F01M 5/002 165/167
2007/0261834 A1* 11/2007 Yang ..... F28D 9/005 165/167
2011/0290462 A1 12/2011 Andersson et al.

FOREIGN PATENT DOCUMENTS

| | | | | |
|---|---|---|---|---|
| DE | 196 11 447 | C1 | | 7/1997 |
| EP | 0 347 961 | A1 | | 12/1989 |
| EP | 1 936 311 | A1 | | 6/2008 |
| GB | 580368 | | * | 9/1946 |
| GB | 1 277 872 | A | | 6/1972 |
| GB | 2 275 996 | A | | 9/1994 |
| JP | 62-013996 | A | | 1/1987 |
| JP | 62-013998 | A | | 1/1987 |
| JP | 08-082496 | A | | 3/1996 |
| JP | 11-094487 | A | | 4/1999 |
| JP | 2004-333083 | A | | 11/2004 |
| WO | 2007/036963 | A1 | | 4/2007 |
| WO | WO 2010/069873 | A1 | | 6/2010 |

OTHER PUBLICATIONS

Written Opinion (PCT/ISA/237) dated Feb. 4, 2013, by the European Patent Office as the International Searching Authority for International Application No. PCT/EP2012/061651.

* cited by examiner

REINFORCEMENT ARRANGEMENT FOR A MODULE OF HEAT TRANSFER PLATES IN A PLATE HEAT EXCHANGER

TECHNICAL FIELD

The present invention relates to a module of heat transfer plates according to the precharacterizing portion of claim 1. The present invention further relates to a plate heat exchanger comprising such a module of heat transfer plates.

BACKGROUND

Plate heat exchangers provided with heat transfer plates are utilized for exchange of heat between two or more heat exchange fluids. The heat transfer plates may be welded together. The heat transfer plates form plate interspaces adapted to be flowed through by the heat exchange fluids. In some types of plate heat exchangers the plates are provided with port holes which form port channels extending at least partially through the plate heat exchanger. The heat exchange fluids may be e.g. gases, liquids, liquids containing solid matter, etc.

At least one of the heat exchange fluids flows through one of the port channels into selected plate interspaces, over heat exchange surfaces of the plates, to a second port channel. The heat transfer plates are commonly mounted between two thick plates, such as two frame plates. The frame plates ensure that the heat exchanger withstands the pressure of the heat exchange fluids and at least one of the frame plates comprises connections for leading at least one of the heat exchange fluids into and/or out from the port channels.

A fluid-tight seal must be provided between a frame plate and an outer heat transfer plate around its port hole/s. One factor in achieving such a seal is to provide a firm connection with the port hole/s of the outer heat transfer plate, which connection will withstand the pressure required to achieve the fluid tight seal. Otherwise, the outer heat transfer plate may fail in an area of the port hole/s.

GB 2275996 discloses a heat exchanger comprising modules of plates being welded together in pairs. The modules are clamped together between two covers. Sealing and/or spacing rings are arranged between the modules and form part of feed pipes for heat exchange fluid. By forming part of the feed pipes and thus, being arranged in line with holes in plates, the sealing and/or spacing rings support the plates around the holes. The plates may thus be made from relatively thin sheet material, approximately <0.5 mm.

SUMMARY

An object of the invention is to provide a module of heat transfer plates welded to each other which allows a high sealing force pressure to be applied to the module around connections leading to a port channel formed in the module.

According to an aspect, the object is achieved by a module of heat transfer plates which are welded to each other. The module comprises:

- a first outer heat transfer plate being provided with a first outer port hole,
- at least a first and a second heat transfer plate each being provided with a first port hole, and
- a first reinforcement arrangement arranged around the first outer port hole.

The first outer and the first heat transfer plates abut against each other and the first and the second heat transfer plates abut against each other such that heat transfer passages are formed between the heat transfer plates, as well as the first outer port hole and the first port holes forming a first port channel in the module. The first reinforcement arrangement comprises:

- a first abutment member comprising a first through hole, the first abutment member being arranged on a side of the first outer heat transfer plate opposite to the first heat transfer plate, and being attached to the first outer heat transfer plate by means of a first weld joint along the first through hole and the first outer port hole, and
- a first supporting member extending at least partially around the first weld joint between the first abutment member and the first outer heat transfer plate.

The first supporting member abuts against the first abutment member and the first outer heat transfer plate.

Since the first supporting member is arranged between the first abutment member and the first outer heat transfer plate and abuts against the first abutment member and the first outer heat transfer plate, forces resulting from sealing pressure at an end of the first port channel, when the module is clamped in a plate heat exchanger, are distributed from the first abutment member via the first supporting member to the first outer heat transfer plate. Additionally, a thicker, and thus stiffer, section is achieved around the first outer port hole by the first supporting member, the first abutment member and the first outer heat transfer plate together than by the first outer heat transfer plate alone. As a result, the above mentioned object is achieved. Furthermore, the first abutment member and the first outer heat transfer plate may be manufactured from the same material, which material may be selected for its properties in relation to the heat exchange fluids to be used in the module and which material may be welded. The first supporting member, which does not come in contact with the heat exchange fluids, may be manufactured from a different material, which material may be selected from a strength perspective instead.

Thanks to the use of the first supporting member and the first abutment member, even thin heat transfer plates may thus be used in conjunction with high sealing pressures. The plate thickness of the heat transfer plates may be as thin as about 0.4 mm. The thickness of the heat transfer plates may be between 0.4-2 mm, more specifically between 0.6-1.0 mm. The first supporting member may comprise several parts or may be complemented with further supporting members arranged at least partially around the first weld joint. The first supporting member may have a thickness of 1-5 mm. Port channels for at least one heat exchange fluid are formed in the module. Other heat exchange fluids may be administered into, and out from, the heat transfer passages via further port channels or via openings along edges of the heat transfer plates. The heat exchange fluids may be e.g. gases, liquids, liquids containing solid matter, etc.

According to embodiments, the first abutment member may comprise a flat portion extending around the first through hole in a plane substantially parallel to the first outer heat transfer plate. Such a flat portion may seal against a sealing surface.

According to embodiments, the first supporting member may have has a substantially flat shape. In this manner the first supporting member may abut against the first abutment member over a substantial area thereof as well as against a substantial projected area of the first supporting member on the first outer heat transfer plate. The first supporting member may have the form of a plain washer surrounding the first outer port hole.

According to embodiments, the first supporting member may be held in place between the first abutment member and the first outer heat transfer plate only by extending around the first weld joint and abutting against the first abutment member and the first outer heat transfer plate. In this manner the first supporting member need not be welded to the outer heat transfer plate or the abutment member, thereby allowing a different material to be selected for manufacturing the first supporting member than for the outer heat transfer plate or the abutment member. Also, the first supporting member will not restrict movement, e.g. due to thermal expansion, of the first outer heat transfer plate and/or the first abutment member in a plane substantially parallel to the first outer heat transfer plate.

According to embodiments the first abutment member may extend a first distance in the plane substantially parallel to the first outer heat transfer plate. The first supporting member may extend a second distance in the plane substantially parallel to the first outer heat transfer plate. The second distance may be the same as, or longer than, the first distance.

A further object of the invention is to provide a plate heat exchanger comprising heat transfer plates welded to each other, in which plate heat exchanger a high sealing force pressure may be applied to the heat transfer plates in an area of a port channel of a plate heat exchanger.

According to a further aspect, a plate heat exchanger comprises a first frame plate and a second frame plate. The plate heat exchanger further comprises a first module of heat transfer plates clamped between the first and the second frame plate. The first module is a module according to the above-mentioned aspect, and optionally according to any of the above mentioned embodiments.

Thus, the first abutment member of the first reinforcement member provides part of a sealing arrangement forming part of a transition between the first port channel and the frame plate. The abutment member thus may seal against the first frame plate, or against a part of the sealing arrangement provided in the first frame plate, supported by the first supporting member and the first outer heat transfer plate. Thus, higher sealing force pressures for a particular thickness of the outer heat transfer plate are withstood with the first reinforcement member than if the first outer heat transfer plate around its first outer port hole were to abut directly against the first frame plate. As a result, the above mentioned further object is achieved.

At least the first frame plate is provided with a first through opening for allowing a heat exchange fluid to pass into, or out from, the first port channel. The heat transfer plates may be provided with further port holes forming a second port channel in the module. The second port channel may be connected to a second through opening provided in one of the first and the second frame plates. Thus, the heat exchange fluid may pass into the plate heat exchanger through the first through opening and the first port channel to enter heat transfer passages formed between the heat transfer plates in the module and pass out from the plate heat exchanger through the second port channel and the second through opening. The first and second through openings may be provided with a lining to protect the relevant frame plate/s from the heat exchange fluid. The plate heat exchanger may be provided for heat exchange between two heat exchange fluids. Further port channels may be formed in the module by further port holes in the heat transfer plates. The module may be provided with a reinforcement arrangement comprising an abutment member and a supporting member at one of its outer heat transfer plates in connection with every port channel. An abutment member and a supporting member may be provided at one end of a port channel or at both ends of a port channel. The frame plates may be clamped together by means of bolts and nuts.

According to embodiments, the first frame plate may be provided with a first through opening which is arranged substantially in line with the first port channel. In this manner the abutment member may seal around the first through opening.

According to embodiments, a first sealing surface may be arranged around the first through opening on an inner side of the first frame plate, which inner side faces the first outer heat transfer plate of the first module. The first abutment member of the first reinforcement arrangement may abut against the first sealing surface. In this manner the abutment member may seal against the sealing surface to ensure a non-leaking connection between the first frame plate and the first port channel.

According to embodiments, the first sealing surface may form part of a separate sealing member. In this manner the first frame plate may be of a common design irrespective of a particular use of a particular heat exchanger and the sealing member may be adapted for use in a particular heat exchange application, taking e.g. temperature and type of heat exchange fluid into consideration. A flexible solution is thus easily achieved.

According to embodiments, the separate sealing member may be arranged in a recess on the inner side of the first frame plate. By suitable choice of the depth of the recess the separate sealing member may be positioned such that the first outer heat transfer plate abuts against the first frame plate when the first abutment member abuts against the sealing surface. Alternatively, if the recess is shallower, a supporting arrangement, such as a supporting plate may be arranged between the first frame plate and the first outer heat transfer plate. Such a supporting plate may also be used in conjunction with a separate sealing element when the first frame plate is not provided with any recess for the separate sealing element.

According to embodiments, the separate sealing member may comprise a metal ring provided with an annular groove, in which groove an elastic sealing element may be arranged. In this manner part of the elastic sealing element may form part of the sealing surface to abut and seal against the first abutment member.

According to embodiments, the plate heat exchanger may comprise a second module of heat transfer plates clamped between the first and the second frame plate. A partition plate may be arranged between the first module and the second module. The second module may be a module according to the above-mentioned aspect, and optionally according to any of the above-mentioned embodiments. Thus, a plate heat exchanger built from modules may be provided. Such a plate heat exchanger may be taken apart despite the heat transfer plates therein being welded together. The modules may be exchanged and/or other service, such as cleaning of the plate heat exchanger may be performed.

According to embodiments, the partition plate may comprise a second through opening. The first module may further comprise:

- a second outer heat transfer plate arranged at an end of the first module opposite to the first outer heat transfer plate and being provided with a second outer port hole such that the second outer port hole forms part of the first port channel in the first module, and
- a second reinforcement arrangement.

The second reinforcement arrangement may comprise:

a second abutment member comprising a second through hole, the second abutment member being attached to the second outer heat transfer plate by means of a second weld joint along the second through hole and the second outer port hole, and a second supporting member extending at least partially around the second weld joint between the second abutment member and the second outer heat transfer plate.

The second supporting member may abut against the second abutment member and the second outer heat transfer plate. The second abutment member may abut against the partition plate around the second through opening such that the second through opening forms part of the first port channel.

In this manner the first port channel from the first module may extend to the first port channel in the second module via the second through opening in the partition plate to form a common port channel in the plate heat exchanger. The feature—the second abutment member abutting against the partition plate—encompasses the second abutment member abutting against a separate sealing member provided in the partition plate, such as discussed above in connection with the separate sealing member of the first frame plate. Furthermore, the first reinforcement member of the second module may provide part of a sealing arrangement forming part of a transition between the first port channel of the second module and the partition plate around the second through opening. The first abutment member of the second module thus may seal against the partition plate, or against a part of the sealing arrangement provided in the partition plate, supported by the first supporting member and the first outer heat transfer plate of the second module. The sealing arrangement provided in the partition plate may be provided by a separate sealing member. The second supporting member may comprise several parts or may be complemented with further supporting members arranged at least partially around the first weld joint.

Accordingly, a plate heat exchanger comprising heat transfer plates which are welded together and having a desired number of heat transfer plates to attain a particular heat exchange capacity may be achieved while the heat exchanger still may provide a comparatively high accessibility to be serviced compared to other plate heat exchangers where the heat transfer plates are welded together. The heat exchange capacity of a plate heat exchanger may be increased by adding more modules using further partition plates being provided with through holes.

Alternatively, the partition plate may not be provided with a through opening at the first port channel. In such a heat exchanger a heat exchange fluid will pass through the heat exchanger in several passes. That is, the heat exchange fluid will pass through the heat transfer passages of the first module to a second port channel and flow through a through opening provided in the partition plate at the second port channel into a second port channel of the second module. The heat exchange fluid will pass through heat transfer passages of the second module to the first port channel of the second module.

According to embodiments, the second module may further comprise:

a second outer heat transfer plate arranged at an end of the second module opposite to the first outer heat transfer plate of the second module and being provided with a second outer port hole such that the second outer port hole forms part of the first port channel in the second module, and a second reinforcement arrangement arranged in connection with the second outer port hole of the second outer heat transfer plate. In this manner a further partition plate may be arranged to abut against the second module at an end opposite to the previously mentioned partition plate. The second reinforcement arrangement of the second module may thus seal against the further partition plate. The first port channel in the second module may thus extend through the second module to the further partition plate as the first port channel in the first module to the previously mentioned partition plate.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions will not necessarily be described in detail for brevity and/or clarity.

Figure 1:
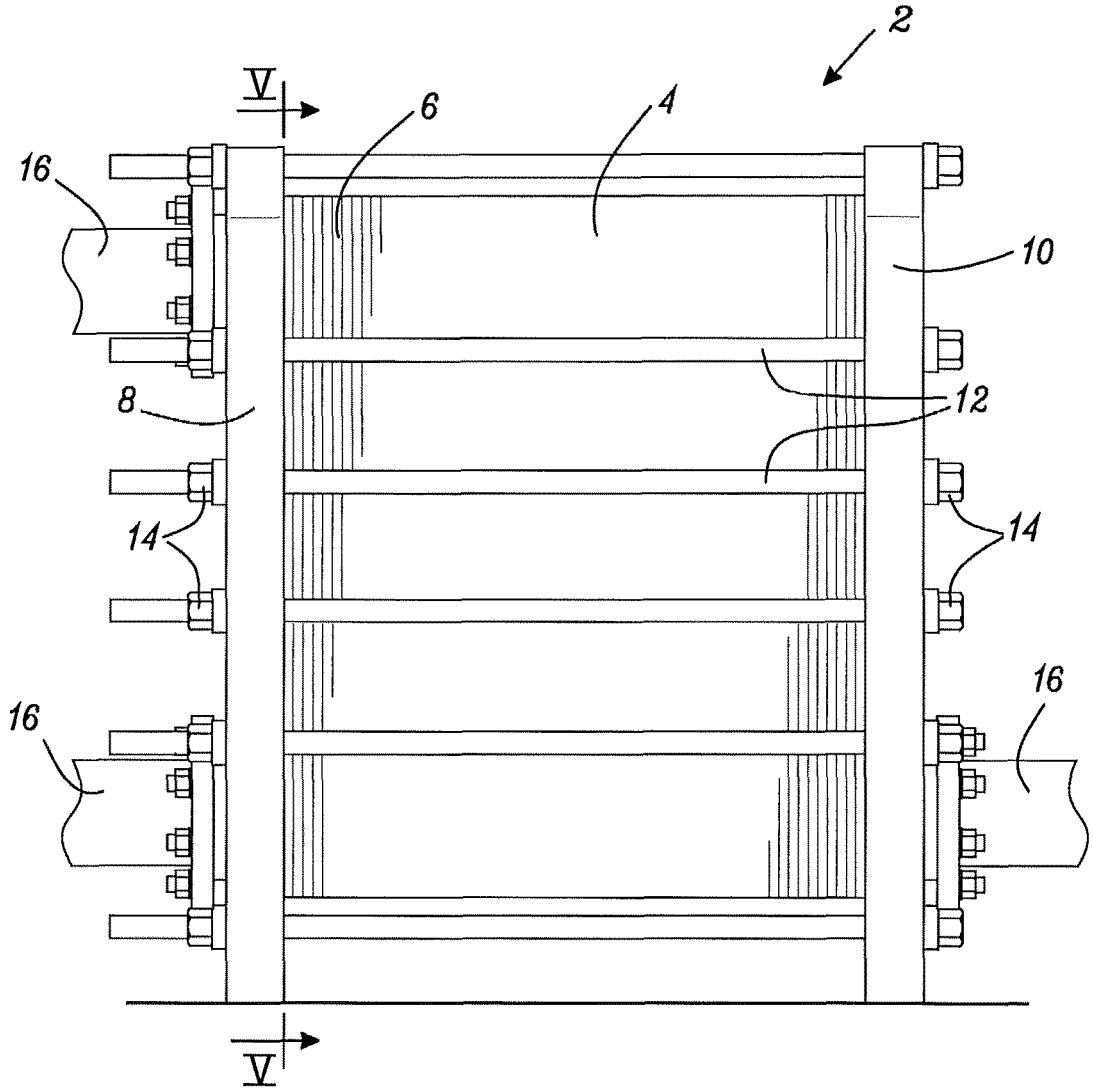
FIG. 1 illustrates a plate heat exchanger according to embodiments.

FIG. 1 illustrates a plate heat exchanger 2 according to embodiments. The plate heat exchanger 2 comprises a module 4 of heat transfer plates 6. The heat transfer plates 6 in the module 4 have been welded together. The module 4 is clamped between a first frame plate 8 and a second frame plate 10. Bolts 12 and nuts 14 are used for clamping the frame plates 8, 10 about the module 4. Pipes 16 are connected to the frame plates 8, 10. The pipes 16 are adapted to lead heat exchange fluids to and from the plate heat exchanger 2.

Figure 2:
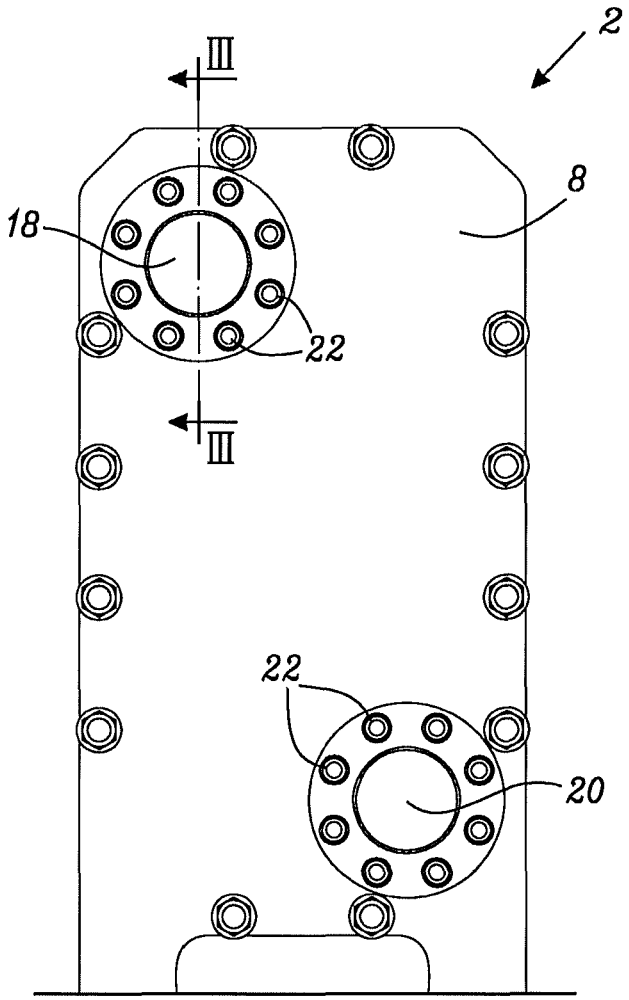
FIG. 2 illustrates the plate heat exchanger of FIG. 1 in a direction facing a first frame plate.

FIG. 2 illustrates the plate heat exchanger 2 of FIG. 1 in a direction facing the first frame plate 8. The pipes 16 are not illustrated in FIG. 2. The first frame plate 8 is provided with a first through opening 18 and a further through opening 20. Via the first through opening 18 a first heat exchange fluid may flow into, or out from, the plate heat exchanger 2. Either the first heat exchange fluid or a second heat exchange fluid may flow through the further through opening 20. Threaded stud bolts 22 are provided at the first frame plate 8 for connecting to flanged connections of the pipes 16.

Figure 3:
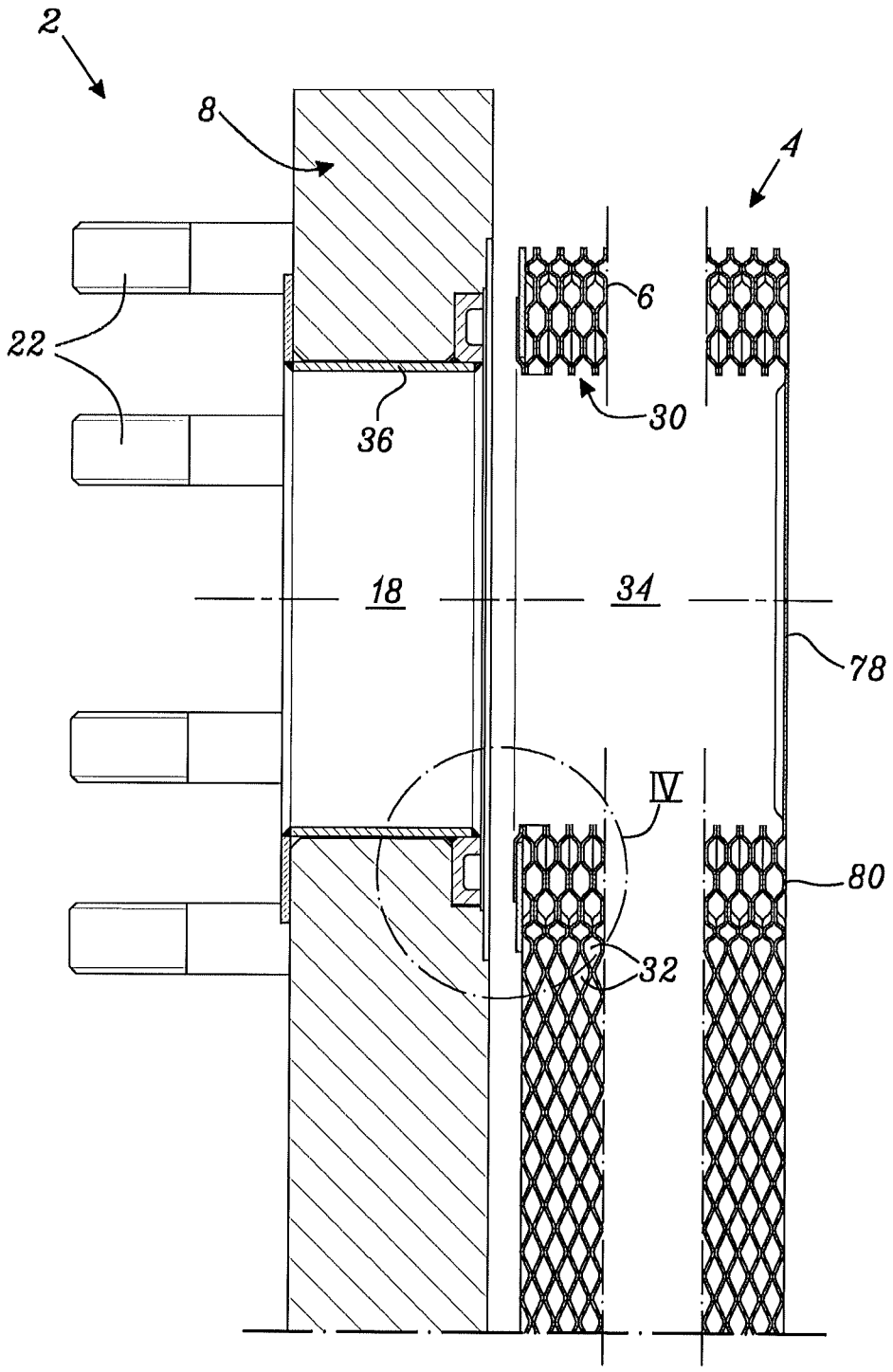
FIG. 3 shows a cross section through the plate heat exchanger of FIG. 2 along line III-III in an exploded view.

FIG. 3 shows a cross section along line III-III through the plate heat exchanger 2 of FIG. 2. The module 4 comprises heat transfer plates 6 which are provided with port holes 30. Between the heat transfer plates 6, heat transfer passages 32 for two heat exchange fluids are formed. The port holes 30 form a first port channel 34 in the module 4. The first port channel 34 communicates with every second of the heat transfer passages 32. The heat transfer plates 6 in the module 4 are welded together along outer edge portions and around their port holes 30. The first through opening 18 in the first frame plate 8 communicates with the first port channel 34. The first through opening 18 is provided with a lining 36. For the sake of clarity the module 4 is shown spaced from the first frame plate 8 in FIG. 3, though in reality the module 4 abuts against the first frame plate 8, as depicted in FIG. 4.

Figure 4:
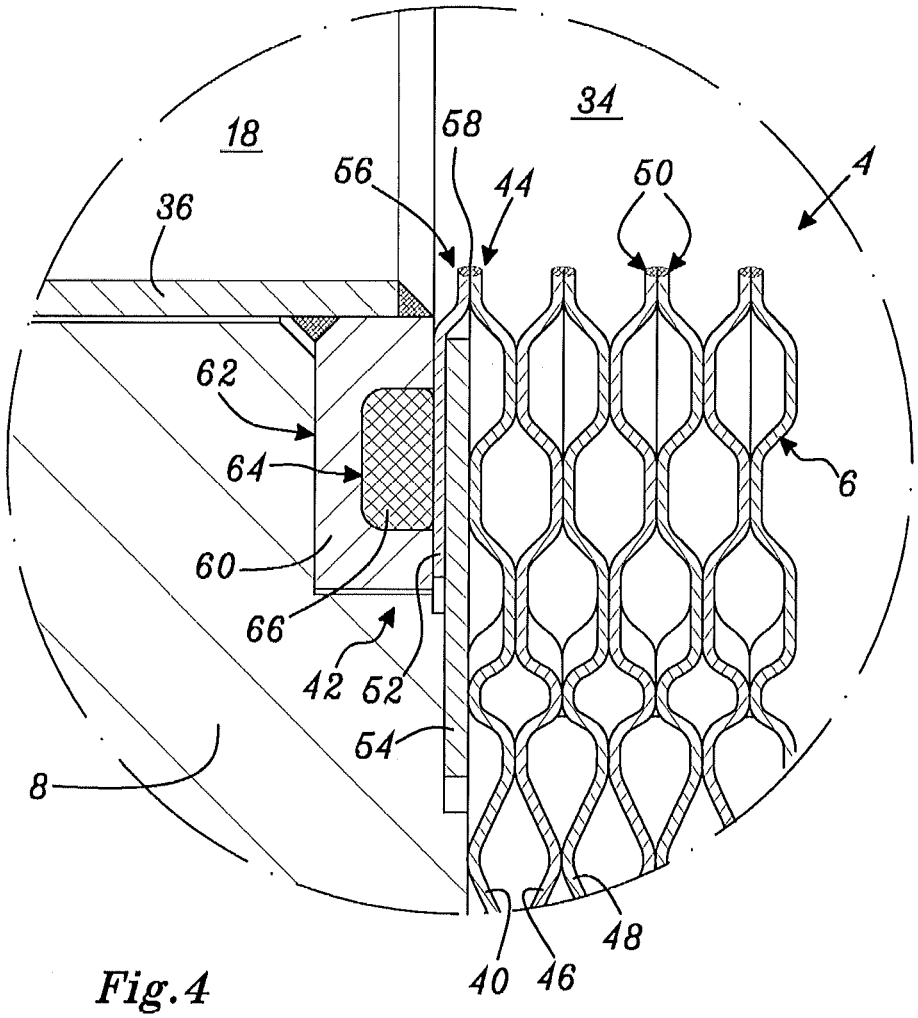
FIG. 4 shows an enlargement of an encircled portion IV of the cross section shown in FIG. 3.

FIG. 4 shows an enlargement of an encircled portion IV of the cross section shown in FIG. 3 with the module 4 abutting against the first frame plate 8. A first outer heat transfer plate 40 of the heat transfer plates 6 of the module 4 abuts against, and thus is supported by, the first frame plate 8. The module 4 comprises a reinforcement arrangement 42 arranged at a first outer port hole 44 of the first outer heat transfer plate 40. Each of a first heat transfer plate 46 and a second heat transfer plate 48 of the heat transfer plates 6 is provided with a first port hole 50. The first outer heat transfer plate 40 and the first heat transfer plate 46 abut against each other. The first heat transfer plate 46 and the second heat transfer plate 48 abut against each other. The first outer port hole 44 and the first port holes 50 form part of the first port channel 34 in the module 4. The first reinforcement arrangement 42 comprises a first abutment member 52 and a first supporting member 54.

The first abutment member 52 has in the disclosed embodiment a disk shape with at least two surfaces arranged in different levels, a first circumferential surface arranged to be received in a recess 62 on the inner side of the first frame plate 8 to be discussed below, and a second circumferential surface arranged to delimit a part of the first port channel 34. The first abutment member 52 comprises a first through hole 56 in the second circumferential surface and is arranged between the first frame plate 8 and the first outer heat transfer plate 40, i.e. on a side of the first outer heat transfer plate 40 opposite to the first heat transfer plate 46. The abutment member 52 is attached to the first outer heat transfer plate 40 by means of a first weld joint 58 along the first through hole 56 and the first outer port hole 44. The first weld joint 58 does preferably extend along the full perimeter of the first through hole 56 and the first outer port hole 44. The first supporting member 54 extends around the first weld joint 58 between the first abutment member 52 and the first outer heat transfer plate 40. The first supporting member 54 has a substantially flat shape and abuts against the first circumferential surface of the first abutment member 52 and the first outer heat transfer plate 40. The first supporting member 54 is held in place between the first abutment member 52 and the first outer heat transfer plate 40 by extending around the first weld joint 58 and abutting against the first abutment member 52 and the first outer heat transfer plate 40. No welding is required to keep the first abutment member 54 in place.

The first abutment member 52 comprises a flat portion, formed by the first circumferential surface of the first abutment member 52, extending around the first through hole 56 in a plane substantially parallel to the first outer heat transfer plate 40. The flat portion abuts and seals against a first sealing surface arranged around the first through opening 18 at an inner side of the first frame plate 8. The first sealing surface is provided on a separate sealing member 60. The separate sealing member 60 comprises a metal ring provided with an annular groove 64 extending in the metal ring around the first through opening 18. In the annular groove 64 an elastic sealing element 66 is arranged. The elastic sealing element 66 may comprise Teflon, high temperature resistant rubber compound, expanded graphite or other suitable sealing material dictated by a particular heat exchanger use. The separate sealing member 60 is arranged in a recess 62 on the inner side of the first frame plate 8. Also the abutment member 52 and the supporting member 54 are arranged in the recess 62. The recess 62 is preferably provided with a number of shoulders, each having a depth for the purpose of receiving the sealing member 60, the abutment member 52 and the supporting member 54 respectively. Thereby the outermost component being the supporting member 54 may be in level with the first outer heat transfer plate 40. Thus, due to the recess 62, the first outer heat transfer plate 40 may abut against the inner side of the first frame plate 8. The separate sealing member 60 may be welded to the lining 36 arranged in the first through opening 18.

The first abutment member 52 extends a first distance in a plane substantially parallel to the first outer heat transfer plate 40, for instance the first abutment member 52 may have a first diameter. The first supporting member 54 extends a second distance in the plane substantially parallel to the first outer heat transfer plate 40, for instance the first supporting member 54 may have a second diameter. The second distance is longer than the first distance, i.e. the second diameter is larger than the first diameter. The first reinforcement arrangement 42 distributes the sealing pressure at the sealing surface from the first frame plate 8 to the outer heat transfer plate 40 over a larger portion than only around the first outer port hole 44. Thus, a high sealing force pressure will not deform the outer heat transfer plate 40 and a reliable sealing between the first frame plate 8 and the module 4 may be achieved.

Figure 5:
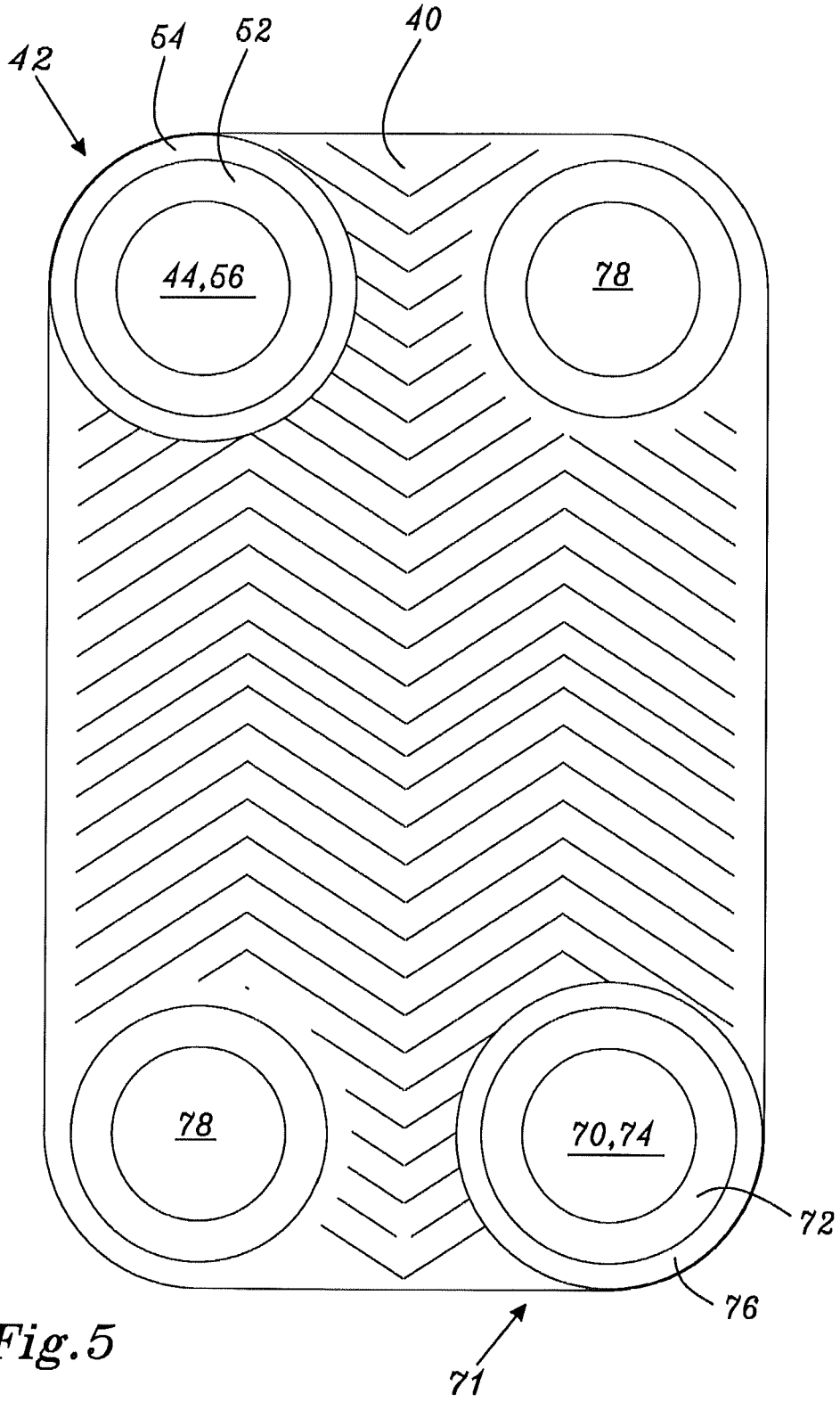
FIG. 5 shows a view along line V-V of FIG. 1 of a first outer heat transfer plate of the plate heat exchanger.

FIG. 5 shows a view of the first outer heat transfer plate 40 of the plate heat exchanger 2 along line V-V of FIG. 1. Around the first outer port hole 44 of the first outer heat transfer plate 40 the first reinforcement arrangement 42, comprising the first abutment member 52 with the first through hole 56 and the first supporting member 54, is arranged. Around a further outer port hole 70 of the first outer heat transfer plate 40 a further reinforcement arrangement (e.g., second reinforcement member) 71, comprising a further abutment member (e.g., second abutment member) 72 with a further through hole 74 and a further supporting member (e.g., second supporting member) 76, is arranged. The first through opening 18 and the further through opening 20 of the first frame plate 8 may thus communicate with the first port channel and a further port channel, respectively, of the module 4 (see FIGS. 1 and 2).

The module 4 comprises two additional port channels. Since the first frame plate 8 is not provided with corresponding through openings (see FIG. 2), the first outer heat transfer plate 40 is not provided with outer port holes at these two additional port channels. Instead the first outer heat transfer plate 40 is provided with port channel closing portions 78 for these two additional port channels. (In FIG. 3 such a closing portion 78 is shown in connection with a second outer heat transfer plate 80 of the module 4.)

Figure 6:
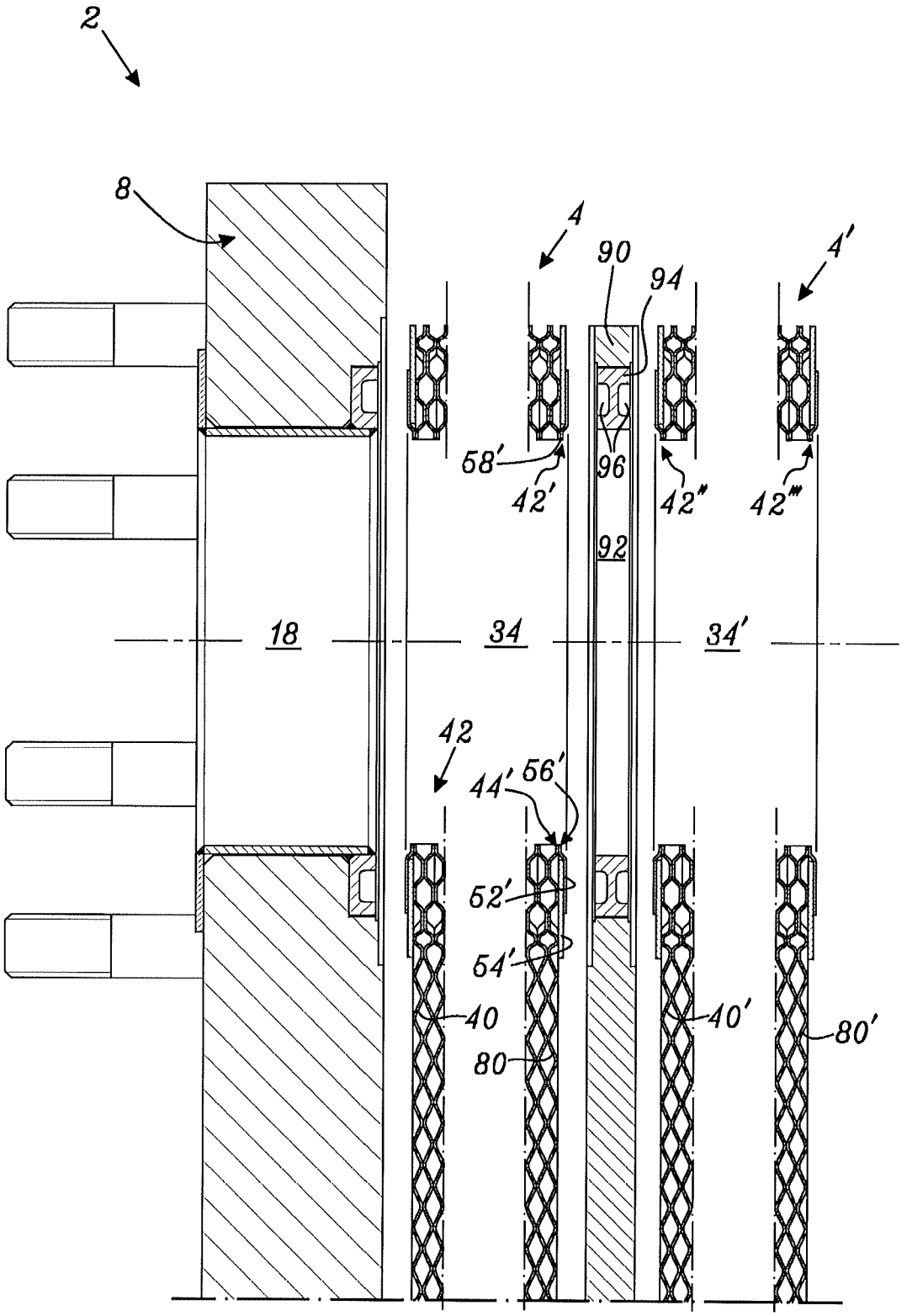
FIG. 6 illustrates an exploded view of a cross section through a plate heat exchanger according to embodiments.

FIG. 6 illustrates an exploded view of a cross section through a plate heat exchanger 2 according to embodiments. The plate heat exchanger 2 resembles to a great extent the plate heat exchanger 2 illustrated in FIGS. 1-5. Accordingly, mainly the differences between the embodiments will be discussed below.

The plate heat exchanger 2 comprises a first module 4 and a second module 4' clamped between a first frame plate 8 and a second frame plate (not shown). A partition plate 90 is arranged between the first module 4 and the second module 4'. The frame plate 8 is provided with a first through opening 18. The partition plate 90 comprises a second through opening 92. A second separate sealing member 94 is provided in the second through opening 92 of the partition plate 90. The second separate sealing member 94 is provided with two annular grooves 96, one grove 96 on each side facing the first and second modules 4, 4', respectively. In the grooves 96 elastic sealing elements may be arranged as discussed above in connection with FIG. 4. Sealing surfaces are thus formed on the both sides of the second separate sealing member 94.

The first module 4 comprises a first reinforcement arrangement 42 in connection with a first outer heat transfer plate 40 as discussed above. The first module 4 further comprises a second outer heat transfer plate 80 arranged at an opposite end of the first module 4 next to the partition plate 90. The second outer heat transfer plate 80 is provided with a second outer port hole 44'. The second outer port hole 44' forms part of a first port channel 34 in the first module 4. Another reinforcement arrangement (e.g., third reinforcement arrangement) 42' is arranged in connection with the second outer port hole 44'. This reinforcement arrangement 42' is designed in the same manner as the first reinforcement arrangement 42 discussed above. Accordingly, the reinforcement arrangement 42' comprises an abutment member (e.g., third abutment member) 52' comprising a second through hole 56'. The abutment member 52' is attached to the second outer heat transfer plate 80 by means of a second weld joint 58' along the second through hole 56' and the second outer port hole 44'. The reinforcement arrangement 42' comprises a supporting member (e.g., third supporting member) 54' extending around the second weld joint 58' between the abutment member 52' and the second outer heat transfer plate 80. The supporting member 54' abuts against the abutment member 52' and the second outer heat transfer plate 80. The abutment member 52' abuts against one of the sealing surfaces of the second separate sealing member 94 in the partition plate 90.

The second module 4' is designed similar to the first module 4 and comprises a first reinforcement 42" in connection with a first outer heat transfer plate 40' and a further reinforcement 42'" in connection with a second outer heat transfer plate 80' as discussed above. A common port channel is formed by the first port channel 34 of the first module 4 and the first port channel 34' of the second module 4' via the second through opening 92 in the partition plate 90. The common port channel may be ended by the second (non-shown) frame plate, which in this case is not provided with a through opening at the common port channel. Alternatively, the second module 4' may be provided with a second outer heat transfer plate 80' comprising a port channel closing portion 78 as disclosed in connection with FIGS. 3 and 5.

The plate heat exchanger 2 may be provided with further partition plates and further modules between the frame plates if higher heat transfer capacity should be required.

Example embodiments described above may be combined as understood by a person skilled in the art. It is also understood by those skilled in the art that the sealing surface, against which an abutment member of a reinforcement arrangement seals may be provided in a relevant frame plate partition plate instead of in a separate sealing element.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments of the present invention have been described herein with reference to cross-section illustrations that are schematic illustrations of idealized embodiments (and intermediate structures) of the invention. As such, variations from the shapes of the illustrations as a result, for example, of manufacturing techniques and/or tolerances are to be expected. Thus, embodiments of the present invention should not be construed as limited to the particular shapes of regions illustrated herein but are to include deviations in shape that result, for example, from manufacturing.

The invention claimed is:

1. A module of heat transfer plates which are welded to each other, the module comprising:

a first outer heat transfer plate being provided with a first outer port hole and a second outer port hole, at least a first and a second heat transfer plate each being provided with a first port hole and a second port hole, a first reinforcement arrangement arranged around the first outer port hole, and a second reinforcement arrangement arranged around the second outer port hole, wherein the first outer and the first heat transfer plates abut against each other and the first and the second heat transfer plates abut against each other such that heat transfer passages are formed between the heat transfer plates, as well as the first outer port hole and the first port holes forming a first port channel in the module, and the second outer port hole and the second port holes forming a second port channel in the module, wherein the first reinforcement arrangement comprises:

a first abutment member comprising a first through hole, the first abutment member being arranged on a side of the first outer heat transfer plate opposite to the first heat transfer plate, and being attached to the first outer heat transfer plate by a first weld joint along the first through hole and along the first outer port hole, and a first supporting member extending at least partially around the first weld joint between the first abutment member and the first outer heat transfer plate, the first supporting member including a through hole different from the first through hole in the first abutment member, wherein the first supporting member abuts against the first abutment member and the first outer heat transfer plate, wherein the second reinforcement arrangement comprises:

a second abutment member comprising a second through hole, the second abutment member being arranged on a side of the first outer heat transfer plate opposite to the first heat transfer plate, and being attached to the first outer heat transfer plate by a second weld joint along the second through hole and along the second outer port hole, and a second supporting member extending at least partially around the second weld joint between the second abutment member and the first outer heat transfer plate, the second supporting member including a through hole different from the first through hole in the first abutment member, wherein the second supporting member abuts against the second abutment member and the first outer heat transfer plate.

2. The module according to claim 1, wherein the first abutment member comprises a flat portion extending around the first through hole in a plane substantially parallel to the first outer heat transfer plate.

3. The module according to claim 1, wherein the first supporting member has a substantially flat shape.

4. The module according to claim 1, wherein the first supporting member is held in place between the first abutment member and the first outer heat transfer plate, only by extending around the first weld joint and abutting against the first abutment member and the first outer heat transfer plate.

5. The module according to claim 1, wherein the first abutment member extends a first distance in a plane substantially parallel to the first outer heat transfer plate, and the first supporting member extends a second distance in the plane substantially parallel to the first outer heat transfer plate, and wherein the second distance is the same as, or longer than, the first distance.

6. A plate heat exchanger comprising a first frame plate and a second frame plate wherein the plate heat exchanger comprises a first module of heat transfer plates according to claim 1 clamped between the first and the second frame plate.

7. The plate heat exchanger according to claim 6, wherein the first frame plate is provided with a first through opening which is arranged substantially in line with the first port channel.

8. The plate heat exchanger according to claim 7, wherein a first sealing surface is arranged around the first through opening on an inner side of the first frame plate, which inner side faces the first outer heat transfer plate of the first module, and wherein the first abutment member of the first reinforcement arrangement abuts against the first sealing surface.

9. The plate heat exchanger according to claim 8, wherein the first sealing surface forms part of a separate sealing member.

10. The plate heat exchanger according to claim 9, wherein the separate sealing member is arranged in a recess on the inner side of the first frame plate.

11. The plate heat exchanger according to claim 9, wherein the separate sealing member comprises a metal ring provided with an annular groove, in which groove an elastic sealing element is arranged.

12. The plate heat exchanger according to claim 6, wherein the plate heat exchanger comprises a second module of heat transfer plates.

13. The plate heat exchanger according to claim 12, further comprising a partition plate that comprises a second through opening and wherein the first module further comprises:

a second outer heat transfer plate arranged at an end of the first module opposite to the first outer heat transfer plate and being provided with a second outer port hole such that the second outer port hole of the second outer heat transfer plate forms part of the first port channel in the first module, and a third reinforcement arrangement, which third reinforcement arrangement comprises:

a third abutment member comprising a third through hole, the third abutment member being attached to the second outer heat transfer plate by a third weld joint along the third through hole and the second outer port hole of the second outer heat transfer plate, and a third supporting member extending at least partially around the third weld joint between the third abutment member and the second outer heat transfer plate, wherein the third supporting member abuts against the third abutment member and the second outer heat transfer plate, and wherein the third abutment member abuts against the partition plate around the second through opening such that the second through opening forms part of the first port channel.

14. The plate heat exchanger according to claim 12, wherein the second module further comprises:

a second outer heat transfer plate arranged at an end of the second module opposite to a first outer heat transfer plate of the second module and being provided with a second outer port hole such that the second outer port hole of the second outer heat transfer plate forms part of the first port channel in the second module, and a third reinforcement arrangement arranged in connection with the second outer port hole of the second outer heat transfer plate.

15. A module of heat transfer plates which are welded to each other, the module comprising:

a first outer heat transfer plate being provided with a first outer port hole, at least a first and a second heat transfer plate each being provided with a first port hole, and a first reinforcement arrangement arranged around the first outer port hole, wherein the first outer and the first heat transfer plates abut against each other and the first and the second heat transfer plates abut against each other such that heat transfer passages are formed between the heat transfer plates, as well as the first outer port hole and the first port holes forming a first port channel in the module, wherein the first reinforcement arrangement comprises:

a first abutment member comprising a first through hole, the first abutment member being arranged on a side of the first outer heat transfer plate opposite to the first heat transfer plate, and being attached to the first outer heat transfer plate by a first weld joint along an inner periphery of the first through hole and along the inner periphery of the first outer port hole, a first supporting member extending at least partially around the first weld joint between the first abutment member and the first outer heat transfer plate, the first supporting member including a through hole possessing an inner periphery positioned radially outwardly of the first weld joint, the first supporting member abutting against the first abutment member and the first outer heat transfer plate, and the first abutment member extending a first distance in a plane substantially parallel to the first outer heat transfer plate, and the first supporting member extending a second distance in the plane substantially parallel to the first outer heat transfer plate, the second distance being the same as, or longer than, the first distance.

16. The module according to claim 15, wherein the first supporting member is not welded to the first abutment member and is not welded to the first outer heat transfer plate.

17. A module of heat transfer plates which are welded to each other, the module comprising:

a first outer heat transfer plate being provided with a first outer port hole and a second outer port hole, at least a first and a second heat transfer plate each being provided with a first port hole and a second port hole, a first reinforcement arrangement arranged around the first outer port hole, and a second reinforcement arrangement arranged around the second outer port hole, wherein the first outer and the first heat transfer plates abut against each other and the first and the second heat transfer plates abut against each other such that heat transfer passages are formed between the heat transfer plates, as well as the first outer port hole and the first port holes forming a first port channel in the module, and the second outer port hole and the second port holes forming a second port channel in the module, wherein the first reinforcement arrangement comprises:

a first abutment member comprising a first through hole, the first abutment member being arranged on a side of the first outer heat transfer plate opposite to the first heat transfer plate, and being attached to the first outer heat transfer plate by a first weld joint along an inner periphery of the first through hole and along the inner periphery of the first outer port hole, the first abutment member possessing oppositely facing first and second surfaces, a first supporting member extending at least partially around the first weld joint between the first abutment member and the first outer heat transfer plate, the first supporting member possessing oppositely facing first and second surfaces, and the first supporting member and the first abutment member being separate members in which at least a portion of the first surface of the supporting member is in direct contact with the second surface of the first abutment member, and at least a portion of the second surface of the supporting member is in direct contact with the first outer heat transfer plate wherein the second reinforcement arrangement comprises:

a second abutment member comprising a second through hole, the second abutment member being arranged on a side of the first outer heat transfer plate opposite to the first heat transfer plate, and being attached to the first outer heat transfer plate by a second weld joint along the second through hole and along the second outer port hole, and a second supporting member extending at least partially around the second weld joint between the second abutment member and the first outer heat transfer plate, the second supporting member including a through hole different from the first through hole in the first abutment member, wherein the second supporting member abuts against the second abutment member and the first outer heat transfer plate.

18. The module according to claim 17, wherein the first supporting member includes a through hole possessing an inner periphery positioned radially outwardly of the first weld joint.

* * * * *